US012704347B2

(12) United States Patent
Sampson

(10) Patent No.: US 12,704,347 B2
(45) Date of Patent: Aug. 11, 2026

(54) COMPOUND BOW ATTACHMENT APPARATUS TO REDUCE TORQUE AND INCREASE STABILITY

(71) Applicant: Dacane Sampson, McDowell, VA (US)

(72) Inventor: Dacane Sampson, McDowell, VA (US)

( * ) Notice: Subject to any disclaimer, the term of this patent is extended or adjusted under 35 U.S.C. 154(b) by 158 days.

(21) Appl. No.: 18/892,347

(22) Filed: Sep. 21, 2024

(65) Prior Publication Data

US 2026/0085906 A1 Mar. 26, 2026

(51) Int. Cl.
*F41B 5/14* (2006.01)
*F41B 5/10* (2006.01)

(52) U.S. Cl.
CPC ..... *F41B 5/1426* (2013.01); *F41B 5/10* (2013.01)

(58) Field of Classification Search
CPC ..... F41B 5/1426; F41B 5/10; F41B 5/0031; F41B 5/1484; F41B 5/148; F41B 5/1442
See application file for complete search history.

(56) References Cited

U.S. PATENT DOCUMENTS 4,329,972 A * 5/1982 Wilson ..... F41B 5/1469 124/24.1
5,349,937 A * 9/1994 Burling ..... F41B 5/1438 124/86
6,173,707 B1 * 1/2001 Howell ..... F41B 5/14 124/88
8,955,504 B1 * 2/2015 Albanese ..... F41B 5/1426 124/88
11,466,956 B2 * 10/2022 Puffe ..... F41B 5/148
2003/0070669 A1 * 4/2003 Beville ..... F41B 5/10 124/88
2005/0039735 A1 * 2/2005 Perry ..... F41B 5/0005 124/23.1
2007/0084451 A1 * 4/2007 Perry ..... F41B 5/14 124/88
2007/0193571 A1 * 8/2007 Moss ..... F41B 5/14 124/88
2008/0051232 A1 * 2/2008 Henry ..... F41B 5/1469 473/578
2012/0174904 A1 * 7/2012 Greenhoe ..... F41B 5/1426 124/89
2012/0272425 A1 * 11/2012 Peck ..... F41B 5/1473 2/16
2013/0112182 A1 * 5/2013 Martin ..... F41B 5/1403 124/23.1
2014/0360478 A1 * 12/2014 Ady ..... F41B 5/10 124/23.1

(Continued)

*Primary Examiner* — Joshua E Freeman
(74) *Attorney, Agent, or Firm* — Stanzione & Associates, PLLC; Patrick Stanzione

(57) ABSTRACT

The present inventive concept relates to a torque reduction apparatus configured to be easily attached to a front side of a compound bow and includes a finger gripping member that extends along a side of the compound bow. The torque reduction apparatus includes a U-shaped portion with one end attached to an attachment portion to be attached to the front side of a compound bow and a second end including a finger gripping member formed thereon, which extends along the side of a compound bow at an angle to receive outer fingers of a user when the attachment portion is attached to the front side of a compound bow and one hand of a user is gripping the compound bow and the finger gripping member simultaneously.

10 Claims, 6 Drawing Sheets

(56) References Cited

U.S. PATENT DOCUMENTS

| | | | | |
|---|---|---|---|---|
| 2015/0153131 | A1* | 6/2015 | Trpkovski | F41B 5/0094 124/25.6 |
| 2020/0149839 | A1* | 5/2020 | Grace | F41B 5/1476 |

* cited by examiner

COMPOUND BOW ATTACHMENT APPARATUS TO REDUCE TORQUE AND INCREASE STABILITY

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to an apparatus that attaches to a compound bow to eliminate torque applied to the bow and increases stability of the bow when the draw strings of the bow are drawn. More specifically, the present inventive concept relates to an apparatus that easily attaches to a front part of a compound bow and extends to a side of the compound bow to enable fingers of a user to grip and hold while using the compound bow to significantly reduce or eliminate torque and increase stability on the bow when drawing the drawstrings of the compound bow.

2. Description of the Related Art

Many devices have been developed to aid in the gripping of a compound bow for increased stability. However, each of these attempts have failed to prevent twisting of the compound bow due to torque caused by the pulling back on the draw strings of the bow in order to aim and release an arrow from the compound bow. Twisting of the compound bow due to applied torque on the compound bow when the draw strings are pulled results in a decrease in the stability of the compound bow when aiming and releasing an arrow therefrom. Some of the attempts to eliminate twisting of a compound bow and increase the stability of a compound bow are provided below.

U.S. Patent Publication No.: 2003/0070669 by Beville discloses a finger grip 20 which is retrofittable to a riser of a compound bow to enhance the gripping thereof. This finger grip 20 includes first and second rings 22 and 24, respectively, in which two fingers of a user can be inserted. The finger grip 20 includes an adhesive strip 28 on its rear surface to adhere to the forward face 13 of a riser 11 of the compound bow. However, even with a user's fingers inserted through the rings 22, 24 of the finger grip 20 the compound bow is still vulnerable to twisting due do torque applied when the strings of the compound bow are pulled back to aim and release an arrow therefrom. This is because the user's fingers are required to wrap around the center portion of the compound bow, which cannot prevent torque from twisting the bow within the fingers of a user.

U.S. Pat. No. 5,349,937 discloses a grip assembly 38 which is provided as an offset handle. The handle 38 is connected to the riser 12 of a compound bow 10 by a pair of lower and upper riser brackets 42, 44, lower and upper riser hinge rods 46, 48 and lower and upper riser handle hinge rods 50, 52. Further, the upper riser hinge rod 48 is hingedly connected by a pin 58 to the upper handle hinge rod 52 and the lower riser hinge rod 46 is hingedly connected by a pin 60 to the lower handle hinge rod 50. In other words, a very complex combination of parts are required to provide a handle 40 which is offset from the bow 10 such that when the bow 10 is held by the handle 40 and the strings 22 are drawn, the force which flexes the limbs of the bow is reacted through pins 58 and 60 which are in the center plane of the bow 10.

Accordingly, there is a need for a compound bow attachment apparatus that is easily attachable to the bow to prevent twisting due to torque and increases stability of the bow when the draw strings are drawn.

There is also a need for a simply designed apparatus attachable to a compound that prevents twisting of the bow due to torque and increases stability of the bow when the draw strings are drawn.

There is also a need for an apparatus with minimal parts, which is attachable to a compound bow to prevent twisting of the bow due to torque and increases stability of the bow when the draw strings are drawn.

SUMMARY OF THE INVENTIVE CONCEPT

The present general inventive concept provides an apparatus that attaches to a compound bow to significantly reduce or eliminate torque applied to the bow and increase stability of the bow when the draw strings of the bow are drawn. More specifically, the present inventive concept relates to an apparatus that easily attaches to a front part of a compound bow and extends to a side of the compound bow to enable fingers of a user to grip and hold while using the compound bow to significantly reduce or eliminate torque and increase stability on the bow when drawing the drawstrings of the compound bow.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a compound bow attachment apparatus, comprising: a U-shaped member having a middle portion, a first prong extending away from a first end of the middle portion at an angle of approximately 90 degrees, and a second prong extending away from a second end of the middle portion at an angle of approximately 110 degrees; an attachment portion having one end thereof attached to a substantial portion of the first prong of the U-shaped member and having a hole extending therethrough an opposite end thereof to receive a threaded member therethrough to be threaded to a threaded hole formed into a front portion of a compound bow, the attachment portion being attached to the first prong at an angle such that when the attachment member is attached to the front portion of a compound bow the second prong of the U-shaped member extends upward and along a side of the compound bow; and a finger gripping member disposed over the second prong of the U-shaped member, the finger gripping member being configured to receive at least two fingers of a hand of a user when a thumb and pointer finger of the user is gripping the compound bow.

In an example embodiment, the angle at which the attachment portion is attached to the first prong of the U-shaped member is approximately 12 degrees from being in parallel with the first prong.

In another example embodiment, the U-shaped member and the attachment portion are formed of one of a stainless steel or a carbon fiber.

In another example embodiment, the finger gripping member is formed of a rubber material.

In another example embodiment, the finger gripping member is formed of a foam material.

In another example embodiment, the attachment portion is triangular in shape and the hole extending therethrough is disposed adjacent to one of three angles of the triangle The foregoing and/or other features and utilities of the present general inventive concept may also be achieved by providing a torque reduction apparatus for a compound bow, comprising: a U-shaped member having a first end extending away from a middle portion at an angle of approximately 90 degrees and a second end extending away from the middle portion at an angle greater than 90 degrees; an attachment portion having a first side attached to the first end of the U-shaped member and having a hole extending through an opposite side of thereof to receive a threaded member therethrough to secure the attachment portion to a front portion of a compound bow, the attachment portion being attached to the first end of the U-shaped member at an angle slightly tilted with respect to first end of the U-shaped member; and a finger gripping member disposed over the second end of the U-shaped member, the finger gripping member being configured to receive at least two fingers of a hand of a user when a thumb and pointer finger of the user grips the compound bow.

In an example embodiment, the attachment portion is triangular in shape such that the first side is one side of the triangle and the opposite side is one of three angles of the triangle.

In another example embodiment, the angle at which the attachment portion is attached to the first side of the U-shaped member is approximately 12 degrees from being in parallel with the first side and the second end of the U-shaped member extends away from the middle portion at an angle of approximately 110 degrees.

In another example embodiment, the finger gripping member is formed of one of a foam material or a rubber material.

Additional features and utilities of the present general inventive concept will be set forth in part in the description which follows and, in part, will be obvious from the description, or may be learned by practice of the general inventive concept.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1A:
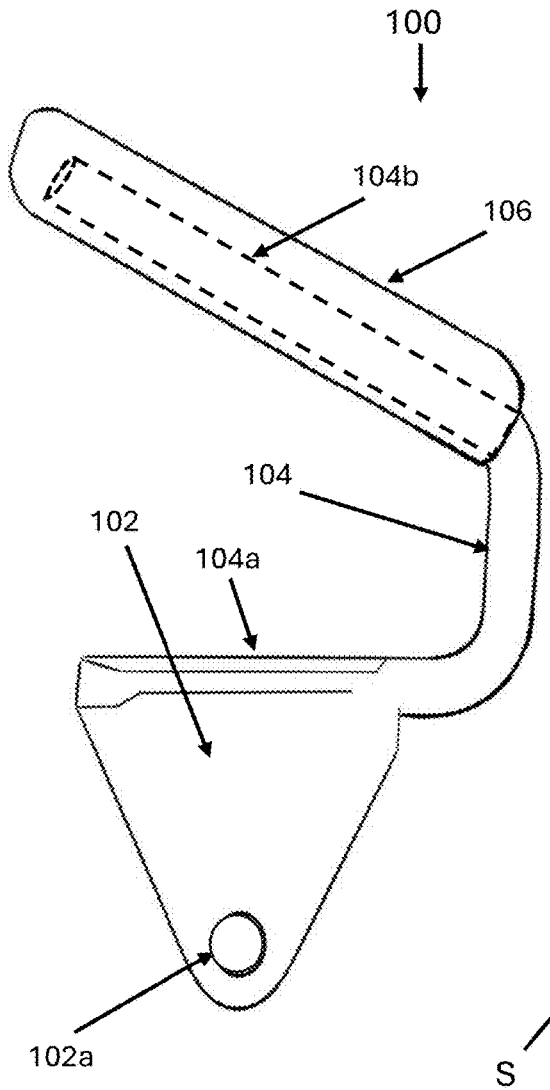
FIG. 1A illustrates a side view of a compound bow attachment apparatus to reduce/eliminate torque and increase stability, according to an example embodiment of the present inventive concept.

The drawing illustrates a process for making the invention according to an example embodiment of the present inventive concept and is not to be considered limiting in its scope, as the overall inventive concept may admit to other equally effective embodiments.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to the intention of the lexicographer, case precedents, or the appearance of new technologies. Also, some terms may be arbitrarily selected by the inventors, and in this case, the meaning of the selected terms will be described in detail in the detailed description herein. Thus, the terms used herein should be defined based on the generally defined meaning of the terms together with the description throughout this specification.

Hereinafter, one or more exemplary embodiments of the present general inventive concept will be described in detail with reference to accompanying drawings.

Example embodiments of the present general inventive concept are directed to a

FIG. 1A illustrates a side view of a compound bow attachment apparatus 100 configured to attach to a front part of a compound bow to reduce/eliminate torque and to increase stability of the compound bow when draw strings of the compound bow are being drawn/pulled, according to an example embodiment of the present inventive concept. The compound bow attachment apparatus 100 according to this example embodiment can include a compound bow attachment portion 102. The compound bow attachment portion 102 can have a triangular shape. Adjacent to one of three points of the triangular compound bow attachment portion 102 can be a hole 102*a* formed therethrough. The hole 102*a* is provided to receive a threaded screw or other threaded device therethrough to attach the attachment portion 102, and therefore the entire compound bow attachment apparatus 100, to the compound bow CB (See FIG. 2A). The compound bow attachment apparatus 100 can also include a U-shaped main body portion 104. The U-shaped main body portion 104 can include a straight middle section and two prongs extending from opposite ends of the straight middle section. A first one of the two prongs 104*a* can be configured to extend away from a first end of the straight middle section of the U-shaped main body portion 104 at an angle of 90 degrees and can be welded to one side of the three-sided (triangular) attachment portion 102. A second one of the two prongs 104*b* can be configured to extend away from a second end of the straight middle section of the U-shaped main body portion 104 at an angle greater than 90 degrees, as described in more detail below while referring to FIG. 2C. The second prong 104*b* can also include a padded "finger grip" member 106 formed or slid over the second prong 104*b* to provide a cushioning feel for the fingers of a user of the compound bow CB). The finger grip member 106 can be formed of a foam material, rubber, or any alternative cushion like material which will serve the purpose of providing a comfortable grip for the fingers of a user. The attachment portion 102, the U-shaped main body portion 104 and the corresponding prongs 104*a*-104*b* can be formed of a stainless steel, carbon fiber, or any other solid material that will withstand the torque created by drawing a drawstring of a compound bow CB back to fire off an arrow.

Figure 1B:
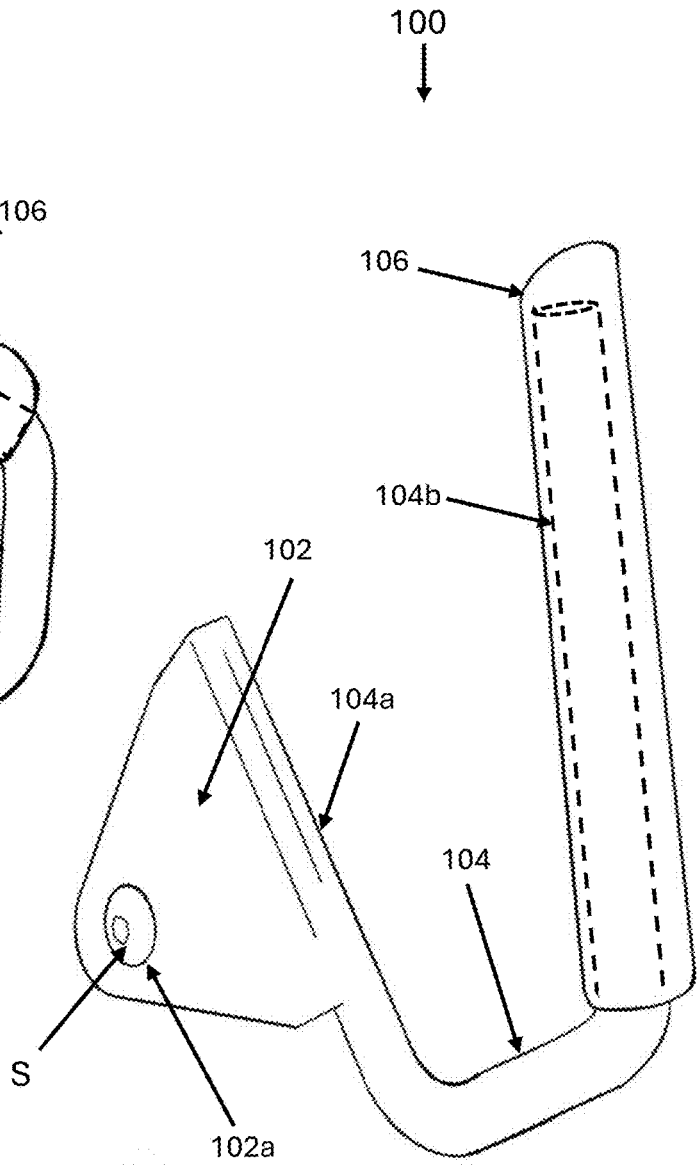
FIG. 1B illustrates a plan view of the compound bow attachment apparatus to reduce/eliminate torque and increase stability, as illustrated in FIG. 1A.

FIG. 1B illustrates a plan view of the compound bow attachment apparatus to reduce/eliminate torque and increase stability of a compound bow, as illustrated in FIG. 1A.

Figure 1C:
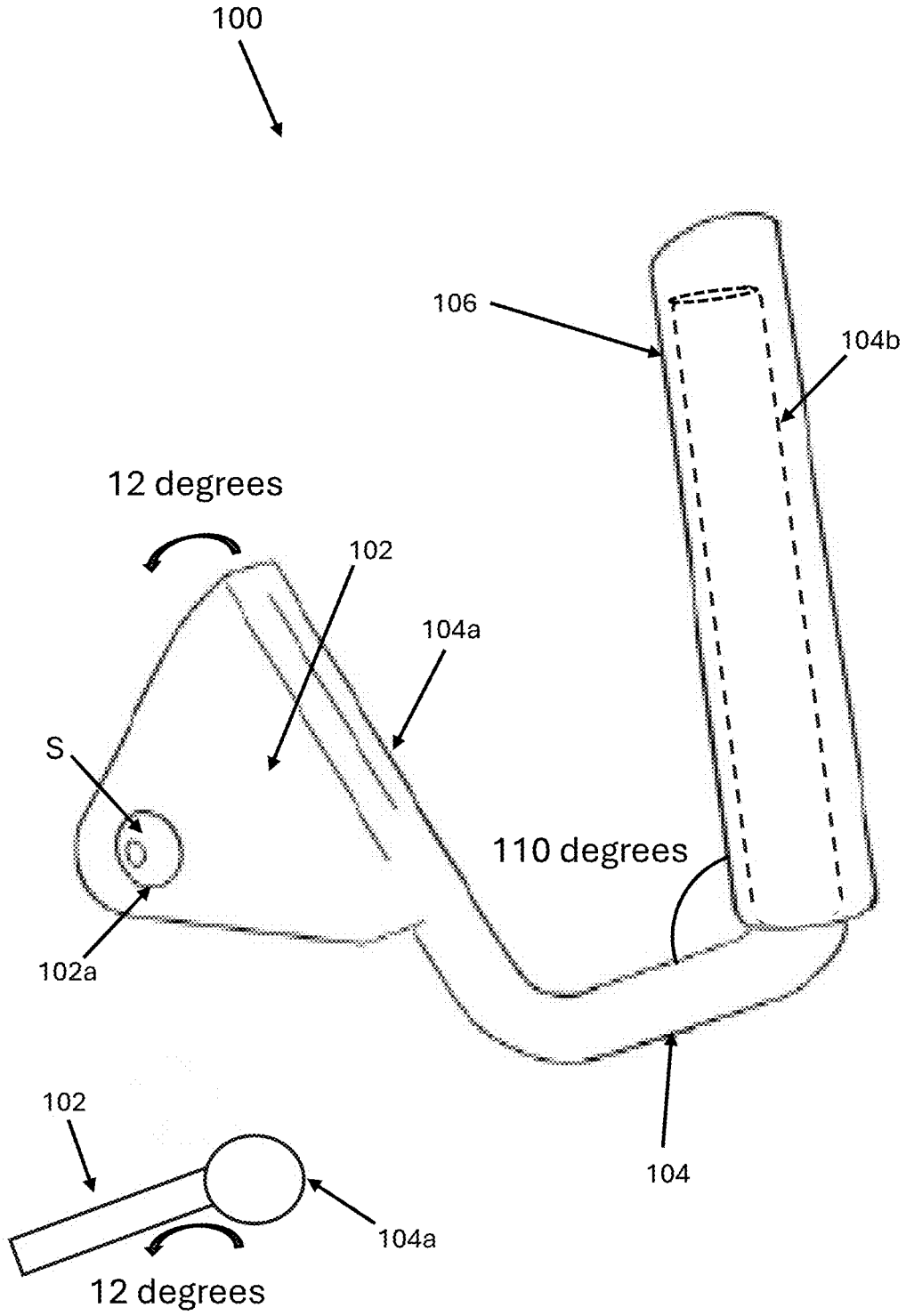
FIG. 1C illustrates another plan view of the compound bow attachment apparatus to reduce/eliminate torque and increase stability, with angle specifications, according to the example embodiment illustrated in FIGS. 1A and 1B.

FIG. 1C illustrates another plan view of the compound bow attachment apparatus 100 configured to reduce/eliminate torque and increase stability of a compound bow, with angle specifications, according to the example embodiment illustrated in FIGS. 1A and 1B. As illustrated in FIG. 1C, the second prong 104*b* of the U-shaped main body portion 104 extends at an angle of approximately 110 degrees away from the U-shaped main body portion 104. As pointed out above, the second prong 104*b* includes the padded finger grip member 106 formed or slid thereover to provide a cushioning touch for the fingers of a user. The angle of the second prong 104*b* with respect to the U-shaped main body portion 104 is designed to provide the best positioning for a user's hand to be angled at approximately 45 degrees with respect to a compound bow CB in which the compound bow attachment apparatus 100 is attached. As well known in the art of archery, when a user is gripping a grip formed on the compound bow with his/her thumb and pointed finger, the other three fingers of the user are best positioned to be extending away from the compound bow at approximately 45 degrees for comfort (See FIG. 2A). Further, in order for the second prong 104*b* of the U-shaped main body portion 104 to extend upward and to a side of the compound bow CB while the attachment portion 102 of the compound bow attachment apparatus 100 is attached to the front portion of the compound bow CB the attachment portion 102 is preferably welded to the first prong 104*a* of the U-shaped main body portion 104 at an angle of approximately 12 degrees, as illustrated in FIG. 1C. With the angle of the attachment portion 102 being welded at approximately 12 degrees with respect to the first prong 104*a* and the angle of the second prong 104*b* being at approximately 45 degrees with respect to the U-shaped main body portion 104 the second prong 104*b* and padded finger grip member 106 combination will extend upward and inward toward the left side of the compound bow, as illustrated in FIG. 2A.

Figure 2A:
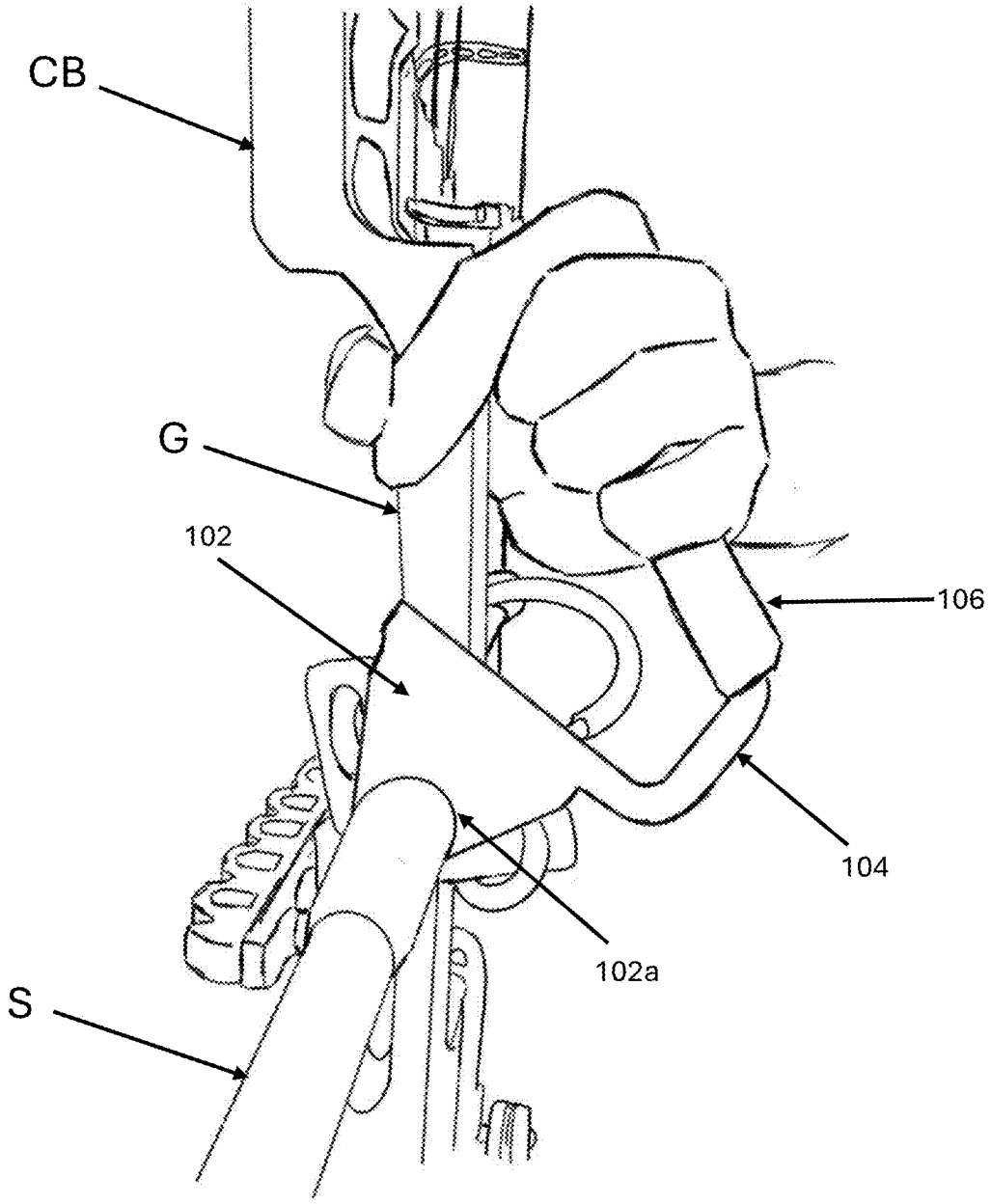
FIG. 2A illustrates a plan view of the compound bow attachment apparatus illustrated in FIG. 1A, while being attached to a front portion of a compound bow via a stabilizer bar and being gripped by a left hand of a user.

FIG. 2A illustrates an operational plan view of the compound bow attachment apparatus 100 according to the example embodiment illustrated in FIG. 1A, while being attached to a front portion of a compound bow CB. In FIG. 2A the attachment portion 102 of the compound bow attachment apparatus 100 is attached to a front portion of a compound bow CB via a commonly used stabilizer bar S. The stabilizer bar S generally includes threads at one end thereof to be threaded into a threaded stabilizer reception hole formed in the front portion of a compound bow CB. The compound bow attachment apparatus 100 can be easily attached to a compound bow CB by unscrewing a stabilizer bar S, placing the hole 102*a* of the attachment portion 102 over the stabilizer reception hole formed in the front portion of the compound bow CB and then threading the stabilizer bar S back into the stabilizer reception hole formed in the front portion of the compound bow CB. Before tightening the stabilizer bar S back onto the compound bow CB the compound bow attachment apparatus 100 can be rotated to a position where the second prong 104*b* and padded finger grip member 106 combination extend adjacent to the left side of the compound bow CB and point inward toward the compound bow CB. Here the second prong 104*b* and padded finger grip member 106 combination will become positioned such that the last three fingers (index, ring and pinky fingers) of a user can comfortably grip the second prong 104*b* and padded finger grip member 106 combination while the user's thumb and pointer fingers grip the grip G of the compound bow CB. In this position the compound bow CB can be held in position such that when the draw strings of the compound bow CB are drawn back any torque on the compound bow CB will be neutralized by the user's three last fingers, thus countering any toque and keeping the compound bow CB stabile from any rotation that would otherwise occur due to the force applied to the bow CB when the draw strings are drawn back.

Figure 2B:
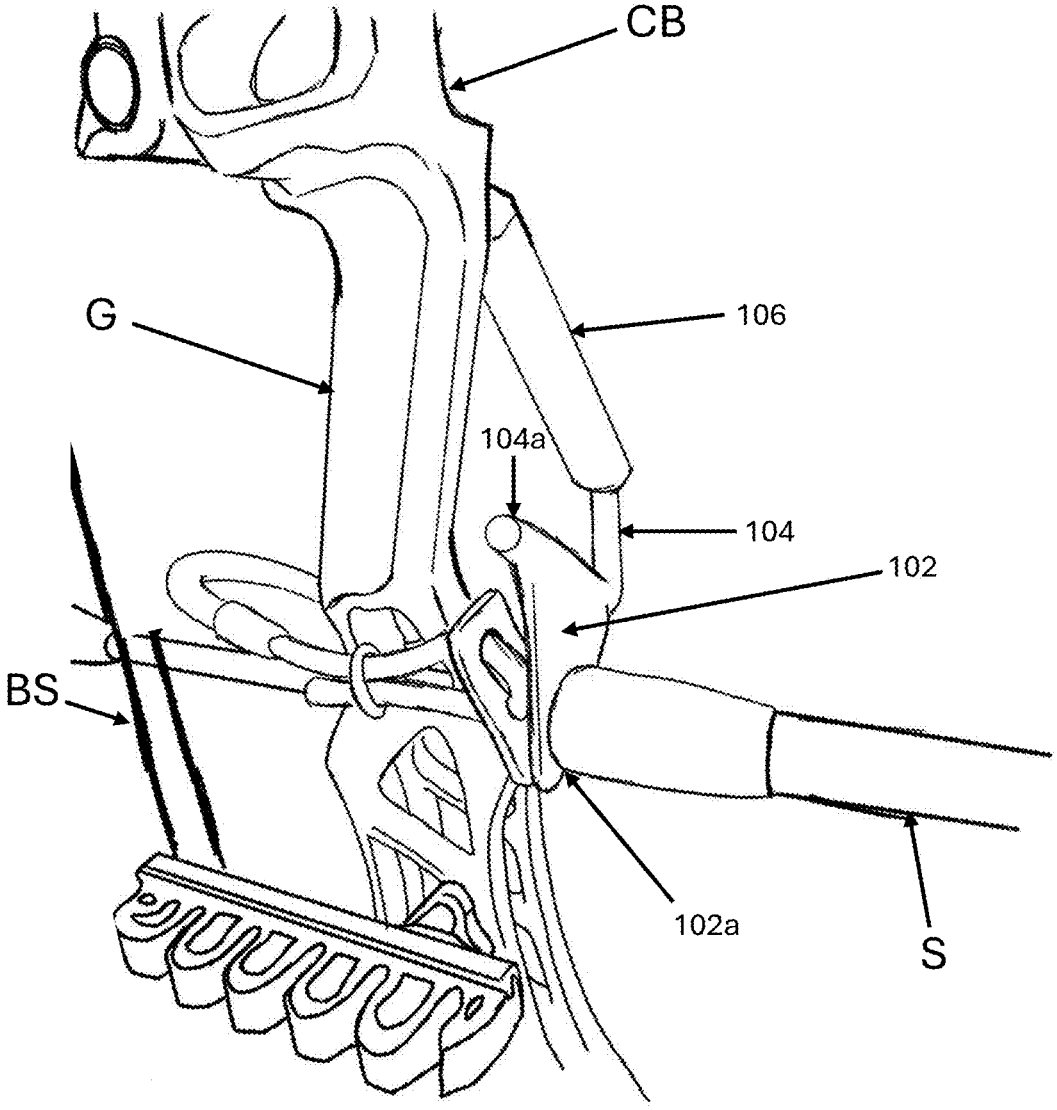
FIG. 2B illustrates another plan view of the compound bow attachment apparatus as illustrated in FIG. 1A, while being attached to the front portion of a compound bow via a stabilizer bar.

FIG. 2B illustrates another plan view of the compound bow attachment apparatus 100 as illustrated in FIG. 1A, while being attached to the front portion of a compound bow via a stabilizer bar. As illustrated in FIG. 2B, the compound bow attachment apparatus 100 can be pivoted about the threaded portion of the stabilizer bar S until the second prong 104*b* and padded finger grip member 106 combination are positioned with respect to the grip G of the compound bow CB such that the user's left hand will be able to comfortably grip both the grip G of the compound bow CB and the second prong 104*b* and padded finger grip member 106 combination simultaneously to eliminate significantly decrease or eliminate any torque applied to the compound bow CB when the draw strings are drawn back to release an arrow.

Figure 3:
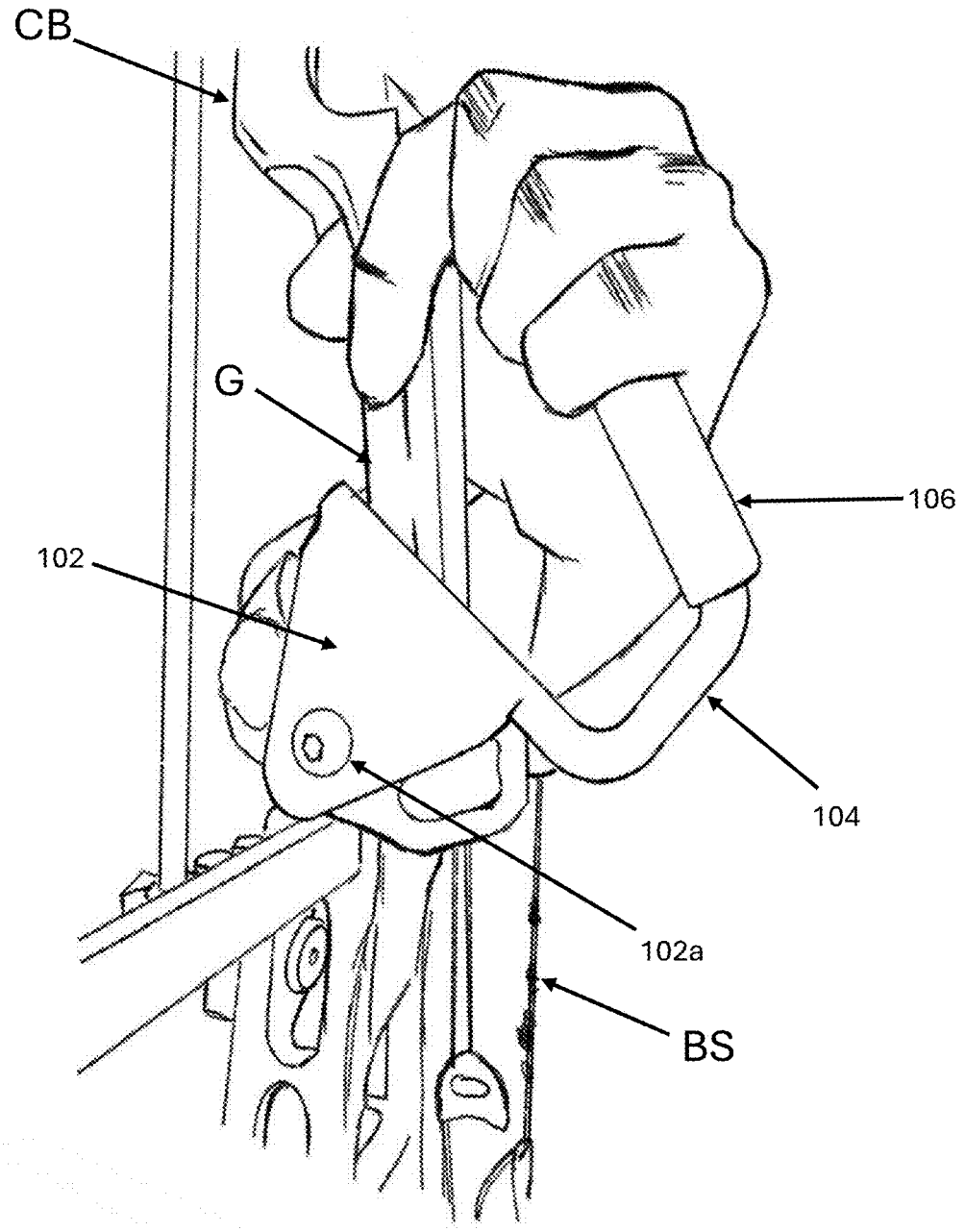
FIG. 3 illustrates still another plan view of the compound bow attachment apparatus as illustrated in FIG. 1A, while being attached to a front portion of a compound bow via a screw and being gripped with a left hand of a user.

FIG. 3 illustrates still another operational plan view of the compound bow attachment apparatus 100 as illustrated in FIG. 1A, while being attached to a front portion of a compound bow via a screw and being gripped with a left hand of a user. FIG. 3 illustrates a situation where the compound bow attachment apparatus 100 can alternatively be fixed to a compound bow CB via a screw threaded into a threaded hole formed into the front portion of the compound bow CB, instead of using a stabilizer bar S.

Figure 4:
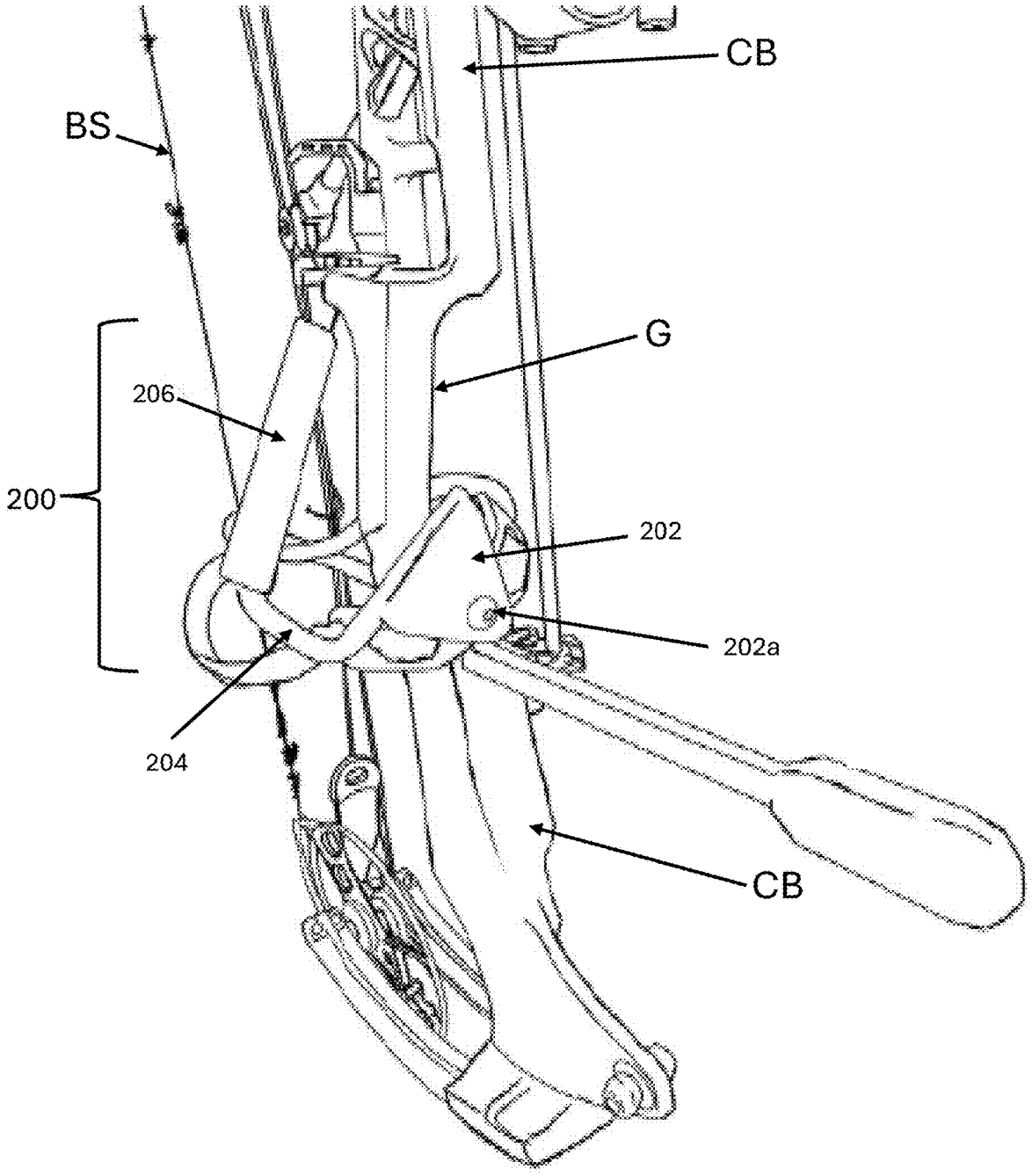
FIG. 4 illustrates a plan view of a compound bow attachment apparatus 200 being attached to a front portion of a compound bow via a screw and configured to be gripped by a right hand of a user, according to another example embodiment of the present inventive concept.

FIG. 4 illustrates a plan view of a compound bow attachment apparatus 200 being attached to a front portion of a compound bow via a screw and configured to be gripped by a right hand of a user, according to another example embodiment of the present inventive concept.

FIG. 4 illustrates a compound bow CB designed to be used by a left-handed user. More specifically, a left-handed user of a compound bow CB will generally grip and hold the compound bow CB with the right hand while drawing the draw string back with the left hand. Here the compound bow attachment apparatus 200 is configured to be attached to a front portion of the compound bow CB by either a screw, as illustrated, or by a stabilizer bar S (not illustrated). The compound bow attachment apparatus 200 can include a compound bow attachment portion 202. The compound bow attachment portion 202 can have a triangular shape similar to the compound bow portion 102 illustrated in the example embodiment of FIGS. 1A-3. Adjacent to one of three points of the triangular compound bow attachment portion 202 can be a hole 202*a* formed therethrough. The hole 202*a* is provided to receive a threaded screw, stabilizer bar, or other threaded device therethrough to attach the attachment portion 202, and therefore the entire compound bow attachment apparatus 200, to the compound bow CB. The compound bow attachment apparatus 200 can also include a U-shaped main body portion 204. The U-shaped main body portion 204 can include a straight middle section and two prongs extending from opposite ends of the straight middle section. A first one of the two prongs 204*a* can be configured to extend away from a first end of the straight middle section of the U-shaped main body portion 204 at an angle of 90 degrees and can be welded to one side of the three-sided (triangular) attachment portion 202. A second one of the two prongs 204*b* can be configured to extend away from a second end of the straight middle section of the U-shaped main body portion 204 at an angle greater than 90 degrees. Preferably the angle in which the second prong 204*b* extends away from the second end of the straight middle section of the U-shaped main body portion 204 is approximately 110 degrees. The second prong 204*b* can also include a padded "finger grip" member 206 formed or slid over the second prong 204*b* to provide a cushioning feel for the fingers of a user of the compound bow CB. The finger grip member 206 can be formed of a foam material, rubber, or any alternative cushion like material which will serve the purpose of providing a comfortable grip for the fingers of a user. The compound bow attachment apparatus 200 according to this example embodiment is configured such that once the attachment portion 202 is attached to the front portion of a compound bow CB designed for a left-handed user the second prong 204*b* and finger grip member 206 will extend to the right side of the compound bow CB and point upward and toward the right side of the compound bow CB. With this configuration a user will hold the compound bow CB with their left hand by gripping the grip B of the compound bow CB with their thumb and pointer fingers while gripping the finger grip member 206 with their remaining fingers, thus holding the compound bow CB such that any torque created by pulling back the draw string of the bow CB will be significantly reduced or eliminated, and the compound bow CB will remain steady and stable throughout the entire process of pulling back the draw string and then releasing the draw string to fire off an arrow.

The finger grip member 206 can be formed of a foam material, rubber, or any alternative cushion like material which will serve the purpose of providing a comfortable grip for the fingers of a user. The attachment portion 202, the U-shaped main body portion 204 and the corresponding prongs 204*a*-204*b* can be formed of a stainless steel, carbon fiber, or any other solid material that will withstand the torque created by drawing a drawstring of a compound bow CB back to fire off an arrow.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A compound bow attachment apparatus, comprising:

a U-shaped member having a middle portion, a first prong extending away from a first end of the middle portion at an angle of approximately 90 degrees, and a second prong extending away from a second end of the middle portion at an angle of approximately 110 degrees;

an attachment portion having one end thereof attached to a substantial portion of the first prong of the U-shaped member and having a hole extending therethrough an opposite end thereof to receive a threaded member therethrough to be threaded to a threaded hole formed into a front portion of a compound bow, the attachment portion being attached to the first prong at an angle such that when the attachment member is attached to the front portion of a compound bow the second prong of the U-shaped member extends upward and along a side of the compound bow; and a finger gripping member disposed over the second prong of the U-shaped member, the finger gripping member being configured to receive at least two fingers of a hand of a user when a thumb and pointer finger of the user is gripping the compound bow.

2. The compound bow attachment apparatus according to claim 1, wherein the angle at which the attachment portion is attached to the first prong of the U-shaped member is approximately 12 degrees from being in parallel with the first prong.

3. The compound bow attachment apparatus according to claim 1, wherein the U-shaped member and the attachment portion are formed of one of a stainless steel or a carbon fiber.

4. The compound bow attachment apparatus according to claim 1, wherein the finger gripping member is formed of a rubber material.

5. The compound bow attachment apparatus according to claim 1, wherein the finger gripping member is formed of a foam material.

6. The compound bow attachment apparatus according to claim 2, wherein the attachment portion is triangular in shape and the hole extending therethrough is disposed adjacent to one of three angles of the triangle.

7. A torque reduction apparatus for a compound bow, comprising:

a U-shaped member having a first end extending away from a middle portion at an angle of approximately 90 degrees and a second end extending away from the middle portion at an angle greater than 90 degrees;

an attachment portion having a first side attached to the first end of the U-shaped member and having a hole extending through an opposite side of thereof to receive a threaded member therethrough to secure the attachment portion to a front portion of a compound bow, the attachment portion being attached to the first end of the U-shaped member at an angle slightly tilted with respect to first end of the U-shaped member; and a finger gripping member disposed over the second end of the U-shaped member, the finger gripping member being configured to receive at least two fingers of a hand of a user when a thumb and pointer finger of the user grips the compound bow.

8. The torque reduction apparatus according to claim 7, wherein the attachment portion is triangular in shape such that the first side is one side of the triangle and the opposite side is one of three angles of the triangle.

9. The torque reduction apparatus according to claim 7, wherein the angle at which the attachment portion is attached to the first side of the U-shaped member is approximately 12 degrees from being in parallel with the first side and the second end of the U-shaped member extends away from the middle portion at an angle of approximately 110 degrees.

10. The torque reduction apparatus according to claim 7, wherein the finger gripping member is formed of one of a foam material or a rubber material.

* * * * *